United States Patent [19]

Schneider et al.

[11] Patent Number: 4,601,190

[45] Date of Patent: Jul. 22, 1986

[54] DRAWING INSTALLATION IN A PRESS

[75] Inventors: Franz Schneider, Goeppingen; Peter Pfeifle, Schorndorf; Wolfgang Michael, Goeppingen, all of Fed. Rep. of Germany

[73] Assignee: L. Schuler GmbH, Fed. Rep. of Germany

[21] Appl. No.: 743,080

[22] Filed: Jun. 10, 1985

[30] Foreign Application Priority Data

Jun. 29, 1984 [EP] European Pat. Off. ..... 84107551.8

[51] Int. Cl.[4] ..... B21D 22/00

[52] U.S. Cl. ..... 72/347; 72/350

[58] Field of Search ..... 72/347-351

[56] References Cited

U.S. PATENT DOCUMENTS

| | | | |
|---|---|---|---|
| 1,562,988 | 11/1925 | Nelson . | |
| 1,625,991 | 4/1927 | Glasner et al. . | |
| 1,664,485 | 4/1928 | Rode . | |
| 2,243,986 | 6/1941 | Stacy . | |
| 3,530,702 | 9/1970 | Ridder . | |
| 3,914,978 | 10/1975 | Sekaninia . | |
| 4,309,888 | 1/1982 | Miller et al. | 72/350 |

FOREIGN PATENT DOCUMENTS

| | | |
|---|---|---|
| 743080 | 5/1983 | Japan . |
| 2115734 | 9/1983 | United Kingdom . |

*Primary Examiner*—Leon Gilden

*Attorney, Agent, or Firm*—Craig and Burns

[57] ABSTRACT

With workpieces to be drawn, especially large-area body parts or sinks, the possibilities of tearing the walls, respectively, undulated surface structure exists within the area of the corner formation. The present invention is therefore predicated on the concept to match the support pressure to the shaping of the workpiece in the different abutment areas thereof. A number of pressure cylinders fixedly installed in the press table serve for that purpose, whose piston rods are adapted to be to displaced in the vertical direction by way of a pressure plate acting in unison on all piston rods. The piston rods acting on the other end of the support are lowerable under the ram movement against the controllable pressure differing in the pressure chambers by way of valves.

12 Claims, 6 Drawing Figures

DRAWING INSTALLATION IN A PRESS

The present invention relates to a drawing installation in a press, with a pressure plate adjustably supported in the press table and movable by way of at least one pressure unit and with a number of pressure cylinders cooperating with the pressure plate and a sheet-metal support, in case of a multi-partite construction of the sheet-metal support, cooperating with the parts of the sheet-metal support, for holding the workpiece to be drawn at drawing work-tool parts and possibly for the ejection of the workpiece to be deformed in the drawing work tool. Installations of this type are generally known in presses and are utilizable, for example, in the drawing stage of a transfer press.

It is necessary with workpieces to be drawn, especially of large area, such as body parts or dishwashers or sinks that the areas of of greater angular bends in conjunction with corner formation have an equal surface quality and structure as the remaining surface areas. An excessive support pressure of the sheet-metal support leads to cracks in the wall whereas an excessively low support pressure leads to pleats or folds and undulations in the surface structure of the workpieces to be drawn.

A method for forming the rim flange in angularly bent corners of workpieces to be drawn, a drawing work tool or die and a sheet-metal support are disclosed in the DE-OS No. 28 24 723, whereby the sheet-metal support acts on the workpiece to be drawn with stepped support force to avoid material accumulations as a result of contraction during the drawing operation.

A drawing installation for a press is described in the DE-PS No. 32 02 134 which has a pressure plate displaceable in the press table. The pressure plate is located underneath a clamping plate for the bottom work tool or die and is supported in a pressure cylinder fixed at the frame. A number of pressure cylinders adapted to be displaced in the vertical direction in unison with the pressure plate are provided which act by way of a pin plate on ejection pins in the work tool bottom part. The pressure plate is lowered as a result of the drawing operation by way of the pin plate and the ejection pins. After the drawing operation, the pistons of the pressure cylinders are acted upon with a slight pressure which is the same for all pressure cylinders in the sense of an ejection movement for the drawn workpiece whereas the pressure plate is held pneumatically in the downwardly retracted position. The pressure plate follows with a time delay in order to act on the pin plate at the beginning of the next drawing operation.

A drawing pad for a sheet-metal drawing press is described in the DE-OS No. 32 42 705 with a number of pressure cylinders fixedly installed in the press table, whose operating pistons act in unison on a pressure plate at mutually spaced pressure points. In order to avoid fold or pleat formation and cracks in the workpiece to be drawn during the deformation operation, the pressure in each pressure cylinder is adjustable to mutually differing pressure magnitudes by way of pilot control units.

In contrast thereto, it is the object of the present invention to permit the countersupport pressure in the pressure cylinders, which is matched separately to the different drawing conditions in a workpiece to be drawn, to act directly on the sheet-metal support.

The underlying problems are solved according to the present invention in that the pressure cylinders cooperating with the pressure plate and with the sheet-metal support are rigidly secured with their cylinder housing in the press table for the operating condition, with the cylinder spaces possibly formed by the press table, in that the pistons of the pressure cylinders are extended on both sides out of the cylinder housings by way of piston rods which cooperate, on the one hand, with the sheet-metal support and, on the other, with the pressure plate, and in that the cylinder space of each pressure cylinder is in fluid communication on the piston side opposite the sheet-metal support separately with a discharge by way of a valve each variable in the throughflow in case of a passive control or with a pressure aggregate for the pressure medium in case of an active control.

If, according to a further feature of the present invention, each valve is a controllable proportional valve, with which a check valve blocking in the discharge direction is connected in parallel, then the arrangement according to the present invention avoids additional control expenditures. When the cylinder space underneath the piston of each pressure cylinder becomes larger, it is filled, for example, from a reservoir located above the pressure cylinder.

Advantages of the present invention result from the low control and shifting expenditure and from the fact that all pressure cylinders are fixedly installed in the press, respectively, in the press table for the operating condition whereas, for example, for the work tool exchange, they are adjustable in their positions to changed sheet-metal support dimensions.

Further advantages result from the running-in operation of the press facilitated by the present invention and from the fact that the shifting control may be realized hydraulically, pneumatically, as also mixed hydraulically/pneumatically in order to utilize the advantages, for example, of a damped starting and stopping, of the one, as well as of the other system while avoiding the disadvantages, for example, of rust formation as a result of moisture precipitation.

These and other objects, features, and advantages of the present invention will become more apparent from the following description when taken in connection with the accompanying drawing, which shows, for purposes of illustration only, two embodiments in accordance with the present invention, and wherein.

Figure 6:
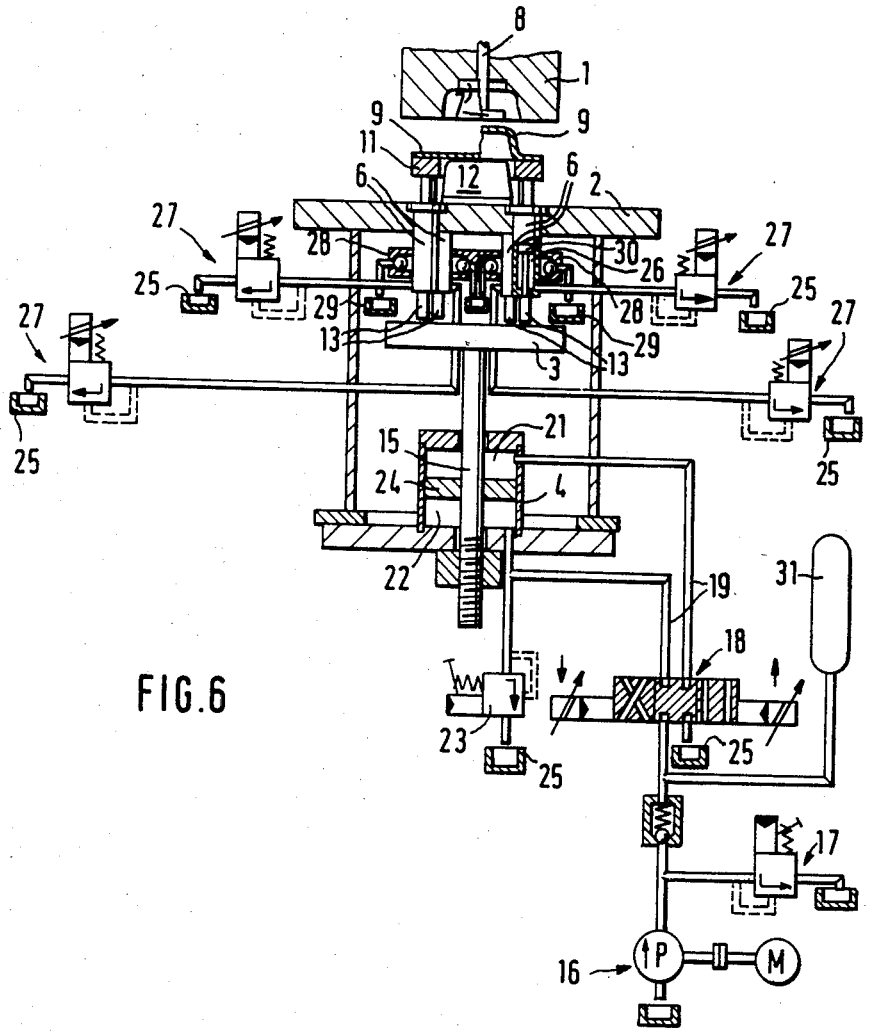
FIG. 6 is a schematic diagram for the hydraulic control of the pressure cylinders in accordance with the present invention.

Referring now to the drawing wherein like reference numerals are used throughout the various views to designate like parts in FIGS. 1 to 6, reference numeral 1 designates a work tool or die upper part secured at the ram of a press, reference numeral 2 a press table, reference numeral 3 a pressure plate, reference numeral 4 a first pressure cylinder fixedly arranged in the press table 2 and reference numeral 6 further pressure cylinders fixedly arranged in the press table 2 for the press operation (drawing operations) but otherwise exchangeable and/or adjustable in the sense of transverse movements during the installation of the drawing work tool. The ram movable in relation to the press table 2, respectively, the work tool or die upper part 1 includes an ejector plate 7 which ejects a formed drawn workpiece 9 during the ram upward movement out of the work tool upper part 1 by way of one or several ejection rods 8. The workpiece 9 to be drawn lies in FIGS. 1, 4, 5 and 6 at the height of the conveying plane on a sheet-metal support member 11 which may also possibly be constructed multi-partite. The support member 11 is supported by way of piston rods 13 of the pressure cylinders 6. The housings of the pressure cylinders 6 may be formed also by hollow spaces in the press table 2 taking into consideration standard dimensions. The piston rods 13 extend on both sides out of the housings of the pressure cylinders 6 and are operatively connected, on the one hand, with the support member 11 and, on the other, with the pressure plate 3. The workpiece 9 to be drawn which is placed into the work tool consisting of work tool or die upper part 1 and of a work tool or die lower part 12, indicated herein as male stamp, is to be deformed in the drawing operation as illustrated in FIGS. 1 to 5. The countersupport force between the support member 11 and the work tool upper part 1 during the drawing operation is produced by the pressure cylinders 6 with corresponding control (FIG. 6). The separate control of each individual pressure cylinder 6 enables an adjustment to conditions specific to deformation, especially in the corner areas of the parts to be drawn. The pressure plate 3 displaceable in height by way of the pressure cylinder 4, of which also several pressure cylinders may be arranged acting in parallel, serves, on the one hand, for lifting the support member 11 into the position for the insertion of the workpiece 9 to be drawn and, on the other, for the ejection of the workpiece 9 up to into the transport plane. The ejection of the workpiece 9, however, may also take place by way of separate ejectors 14 according to the embodiment of FIG. 5. During the drawing operation when the ram is lowered together with the work tool upper part 1, the latter at first comes into contact with and rests on the workpiece 9 to be drawn within the area of the support 11. The further lowering of the work tool upper part 1 and the forming of the workpiece 9 to be drawn in the work tool lower part 12 takes place against the pressure building up in the pressure cylinders 6 with the downward movement of the piston rods 13, respectively, of the pistons 30 (FIG. 6).

Figures 1, 2, 3, 4, 5:
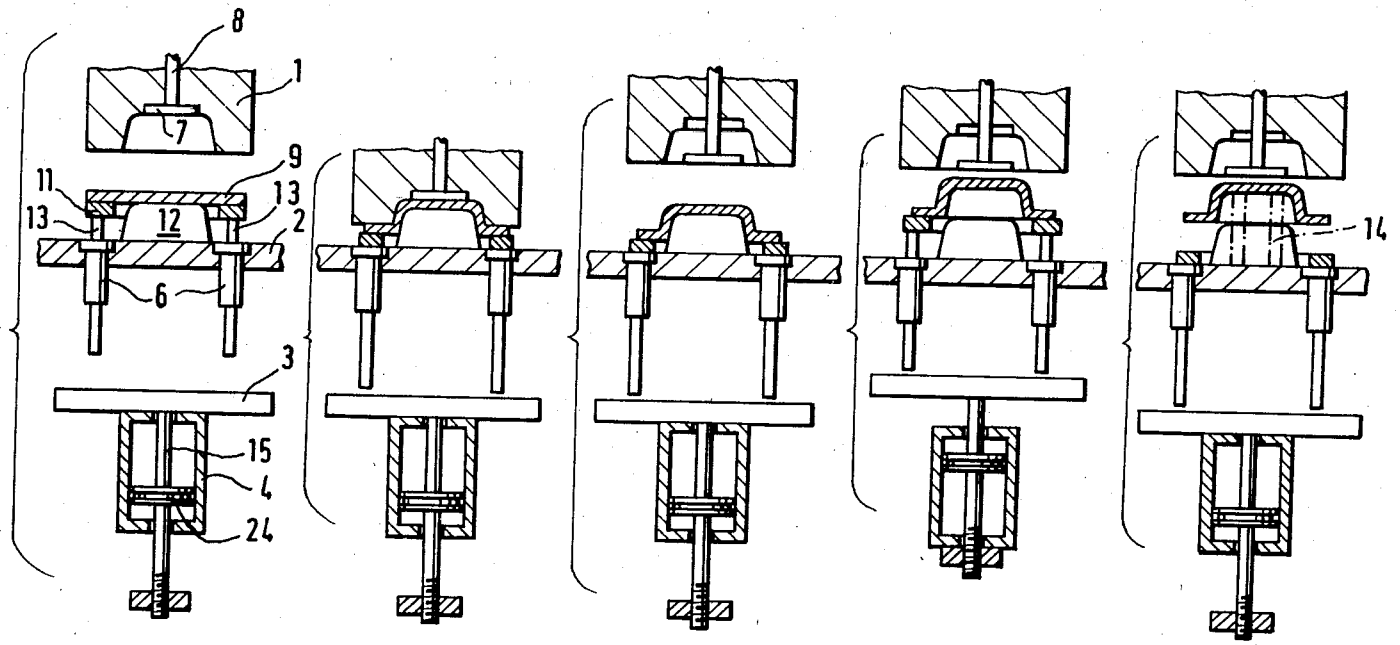
FIGS. 1 to 4 are schematic views, partly in cross section and illustrating in a simplified manner the drawing operation according to the present invention of a sheet-metal part.
FIG. 5 is a similar schematic view, illustrating in a simplified manner the application of an ejector independent of the sheet-metal support in accordance with the present invention.

FIG. 2 illustrates the completed shaping operation whereby the one ends of the piston rods 13 are guided up to within the area of the pressure plate 3 lowered prior to or during the deformation operation, without, however, contacting the same. On the other hand, the ends of the piston rods 13 may then rest on the pressure plate 3 if the same is taken along together with the ram movement.

During the upward movement of the ram while taking along the work tool upper part 1, FIG. 3 illustrates the terminated upward movement, in which the drawn workpiece 9 is pressed out of the work tool upper part 1 by means of the pressure plate 7 and the ejector rod or rods 8. At the same time or time-displaced to the upward movement of the ram and work tool upper part 1, the pressure cylinder 4 is acted upon from the pump aggregate 16 (FIG. 6), possibly from a pressure reservoir 31 in order to lift the workpiece 9 into the transport plane for the workpiece 9 by way of the pressure plate 3, the piston rods 13, and the support member 11. FIG. 4 illustrates the completed operation. After the upward movement of the support member 11, the pressure cylinder 4 is controlled in the opposite direction in order to lower the pressure plate 3 by way of the piston rods 15 thereof. Another possibility provides to control the pressure cylinder 4 in such a manner by way of the multi-path valve 18 illustrated in FIG. 6 that the pressure plate 3 follows the movement of the work tool upper part 1. The pressure for the upward movement of the pressure plate 3 can then be derived also from the pressure reservoir 31.

FIG. 5 illustrates ejectors 14 effecting the ejection operation and the lifting of the workpiece 9 into the transport plane, which are separately controllable by way of, for example, hydraulic pressure cylinders, whereby the support member 11 is to be lifted additionally by means of the pressure plate 3 independently of the upward movement of the workpiece 9 or time-displaced with respect thereto for the accommodation of a new workpiece 9 to be drawn.

FIG. 6 illustrates a control arrangement in principle with the use of the components explained by reference to FIGS. 1 to 5 with a pressure unit consisting of a pump aggregate 16, a pilot pressure unit 17, a multi-path valve 18, which is connected by way of pipe lines 19 with the upper, respectively, lower pressure chambers 21 and 22 of the first pressure cylinder 4 for the selective pressure actuation of the pressure cylinder 4 into the one or the other adjusting direction. The upper pressure chamber 21 is adapted to be brought into fluid communication with a pressure discharge 25 by way of the multi-path valve 18, while the lower pressure chamber 22 is adapted to be brought into fluid communication with a pressure discharge by way of an adjustable safety valve 23. The upward and downward movements of the piston 24, of the piston rod 15 and by way of the latter of the pressure plate 3, takes place by shifting the multi-path valve 18 into corresponding shifting positions.

The lower pressure chambers 26 of the pressure cylinders 6, of which four pressure cylinders are illustrated but which may also be present in a number corresponding to the discrete pressure points at the support member 11, are connected with the pressure discharge 25 by way of a controllable proportional valve 27 each which, however, may also be a pressure limit valve or also, for example, a throttle valve. A common check valve 28 or one check valve 28 each are connected in parallel with these proportional valves 27 which block in the direction of the pressure discharge and are in fluid connection with a pressure medium reservoir 29 for filling the lower pressure chambers 26 during the upward movement of the pressure plate 3. The upper pressure chambers (not shown in detail) of the pressure cylinders 6 are connected during the press operation with the atmosphere, with an inert gas or with a pressureless medium. It is necessary, for example, for the work tool exchange to apply pressure to the upper pressure chambers in order to lower the support member 11, respectively, the piston rods 13. The lowering operation is possible by means of the existing pressure aggregate or of a further pressure aggregate and corresponding control means.

As can be seen from the foregoing, the piston rods 13 of the pressure cylinders 6 and the support member 11 have to be brought into a position, for the accommodation of a new workpiece 9 to be drawn, which corresponds to the transport plane for the workpieces to be drawn. For that purpose, the pressure plate 3 has to be lifted with a corresponding shifting position of the multi-path valve 18 (right shifting position) and application of the lower pressure chamber 22 with pressure. During the upward movement of the piston rods 13, pressure medium flows out of the pressure medium reservoir 29 by way of the check valves 28 into the lower pressure chambers 26 of the pressure cylinders 6 which are located underneath the pistons 30. The pressure plate 3 is thereafter brought into the lower position by shifting the multi-path valve 18 (left shifting position). With the lowering of the ram and movement of the work tool upper part 1 against the workpiece 9 to be drawn, a pressure adjustable for each pressure cylinder 6 by means of the proportional valves 27 will build up in the lower pressure chambers 26 of the pressure cylinders 6. It is understood that the drawing installation is not limited to the vertical position as shown and illustrated. Differing from the passive control described hereinabove, however, also an active control of the lower pressure chambers 26 of the pressure cylinders 6 by means of pressure aggregates and separate quantity-controlled valves (proportional valves) is also possible. For a movement course of the pressure plate 3, synchronous with the ram movement, the upper pressure chamber 21 as well as the lower pressure chamber 22 are to be connected selectively with the pressure reservoir 31, respectively, a pressure discharge 25. The shifting positions of the multi-path valve 18 and of a corresponding pressure-regulating measure of the pump aggregate 16 are not illustrated in detail since they are known to those skilled in the art. It is thereby important that the pressure plate 3 follow the ram during the upward movement thereof with a smaller pressure (10%) than is required as counterpressure during the drawing operation.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A drawing installation in a press, comprising a press table, a pressure plate means adjustably supported in the press table, at least one pressure unit for moving the pressure plate means, support means, drawing work tool means, a number of pressure cylinder means cooperating with the pressure plate means and with the support means for holding the workpiece to be drawn on the drawing work tool means, the pressure cylinder means cooperating with the pressure plate means and with the support means being rigidly secured with their cylinder housing means in the press table for the operating condition, the pressure cylinder means including piston means extending on both sides out of the cylinder housing means by way of piston rods, said piston rods cooperating at one end with the support means and at the other end with the pressure plate means, the contact with the pressure plate causing the pressure cylinder means to hold the workpiece and control means including control valve means subsequently operable to change its through-flow cross section for separately controlling the cylinder space of each pressure cylinder means on the piston side opposite the support means.

2. A drawing installation according to claim 1, wherein with a passive control, the control valve means is operable to selectively connect the cylinder space of each pressure cylinder means on the piston side opposite the support means with a discharge.

3. A drawing installation according to claim 1, wherein with an active control, the control valve means is operable to connect the cylinder space of each pressure cylinder means on the piston side opposite the support means with a pressure aggregate for the pressure medium.

4. A drawing installation according to claim 1, wherein the support means is of multi-partite construction and wherein the pressure cylinder means cooperate with the respective parts of the support means.

5. A drawing installation according to claim 1, wherein the cylinder spaces of the pressure cylinder means are formed by hollow spaces in the press table.

6. A drawing installation according to claim 1, wherein each valve means is a controllable proportional valve with respect to which one check valve is connected in parallel which is operable to block in the discharge direction.

7. A drawing installation according to claim 4, wherein each valve means is a controllable proportional valve with respect to which one check valve is connected in parallel which is operable to block in the discharge direction.

8. A drawing installation according to claim 7, wherein the cylinder spaces of the pressure cylinder means are formed by hollow spaces in the press table.

9. A drawing installation according to claim 7, wherein with a passive control, the control valve means is operable to selectively connect the cylinder space of each pressure cylinder means on the piston side opposite the support means with a discharge.

10. A drawing installation according to claim 7, wherein with an active control, the control valve means is operable to connect the cylinder space of each pressure cylinder means on the piston side opposite the support means with a pressure aggregate for the pressure medium.

11. A drawing installation according to claim 4, wherein with a passive control, the control valve means is operable to selectively connect the cylinder space of each pressure cylinder means on the piston side opposite the support means with a discharge.

12. A drawing installation according to claim 4, wherein with an active control, the control valve means is operable to connect the cylinder space of each pressure cylinder means on the piston side opposite the support means with a pressure aggregate for the pressure medium.

* * * * *